US005832393A

United States Patent [19]

Omata et al.

[11] Patent Number: 5,832,393

[45] Date of Patent: Nov. 3, 1998

[54] METHOD OF TREATING CHELATING AGENT SOLUTION CONTAINING RADIOACTIVE CONTAMINANTS

[75] Inventors: Kazuo Omata, Iruma; Katsumi Shibata, Hasuda; Yukio Shirai, Tokorozawa; Seigo Ichikawa, Nagano, all of Japan

[73] Assignee: Morikawa Industries Corporation, Nagano-ken, Japan

[21] Appl. No.: 766,025

[22] Filed: Dec. 13, 1996

Related U.S. Application Data

[63] Continuation-in-part of Ser. No. 323,819, Oct. 17, 1994, abandoned.

[30] Foreign Application Priority Data

Nov. 15, 1993 [JP] Japan ..... 5-284867

[51] Int. Cl.[6] ..... G21F 9/00

[52] U.S. Cl. ..... 588/20; 588/18; 210/682; 210/765; 205/750; 205/752; 205/771; 376/313; 976/DIG. 376

[58] Field of Search ..... 588/18, 20; 204/149, 204/186; 210/682, 755; 205/750–752, 771; 376/313; 976/DIG. 376

[56] References Cited

U.S. PATENT DOCUMENTS

| | | | |
|---|---|---|---|
| 4,514,270 | 4/1985 | Furutani et al. | 205/702 |
| 4,537,666 | 8/1985 | Murray et al. | 205/673 |
| 4,792,385 | 12/1988 | Snyder et al. | 264/0.5 |
| 4,954,230 | 9/1990 | Kirch | 210/665 |
| 5,024,805 | 6/1991 | Murray | 376/305 |
| 5,122,268 | 6/1992 | Burack et al. | 210/202 |
| 5,536,389 | 7/1996 | La Naour et al. | 205/688 |
| 5,613,239 | 3/1997 | Obinata et al. | 588/1 |

*Primary Examiner*—Ngoclan Mai
*Attorney, Agent, or Firm*—Klima & Pezzlo, P.C.

[57] ABSTRACT

Although a chelating agent solution having radioactive contaminants is solidified by mixing with cement and then stored, a vast storage place is required for storing an enormous amount of chelating agent solution. When such a chelating agent solution is treated with an ion-exchange resin, a large amount of ion-exchange resin is required, and a large amount of ion-exchange resin having radioactive contaminants is produced. The present invention thus provides a method of treating a chelating agent solution having radioactive contaminants, which can significantly decrease the amount of the chelating agent solution having radioactive contaminants, and which, when an ion-exchange resin is used, can significantly decrease the load on the ion-exchange resin without producing a large amount of ion-exchange resin having radioactive contaminants. In this method, a chelating agent solution having radioactive contaminants is electrolyzed by a direct current to produce various gases and eliminate the chelating property, a holding agent such as a coagulant-precipitant or a metal scavenger, which holds metal ions to form a water-insoluble substance, is then added to the chelating agent solution to form an insoluble substance which is then filtered off, and the filtrate is treated with an ion-exchange resin. The produced purified water may be collected, or a chelating agent may be added to the purified water to form a chelating agent solution used for decontaminating a radioactive contaminated substance.

20 Claims, 4 Drawing Sheets

METHOD OF TREATING CHELATING AGENT SOLUTION CONTAINING RADIOACTIVE CONTAMINANTS

RELATED APPLICATION

This application is a continuation-in-part of abandoned U.S. application Ser. No. 08/323,819 filed Oct. 17, 1994.

BACKGROUND OF THE INVENTION

1. Field of the Invention

The present invention relates to a method of treating a chelating agent solution containing radioactive contaminants from an atomic power station.

2. Description of the Related Art

Radioactive contaminated substances are generally washed with a chelating agent solution so that metal ions as contaminants in the contaminated substances are sealed in the chelating agent solution.

A method of treating the chelating agent solution containing the radioactive contaminants sealed therein comprises mixing the chelating agent solution with cement to form a cement paste, getting the cement paste into drum cans, solidifying the paste and then storing the drum cans in a storage place.

Another method comprises passing the chelating agent solution containing the radioactive contaminants through an ion exchange resin so as to remove the contaminants by adsorbing the contaminants on the resin.

However, the method comprising mixing the chelating agent solution containing the radioactive contaminants with cement to form a cement paste, getting the paste into drum cans and solidifying the paste requires a vast storage place for storing an enormous number of drum cans containing the radioactive contaminants. The method of adsorbing the radioactive contaminants on the ion exchange resin has a large load because large amounts of radioactive metal ions are present in the chelating agent solution containing the radioactive contaminants, and thus the adsorption capacity reaches its limit within a short time.

This method thus produces a large amount of ion exchange resin having radioactivity, and requires a vast storage place for storing the ion exchange resin.

SUMMARY OF THE INVENTION

The present invention has been achieved for solving the above problems, and an object of the present invention is to provide a method of treating a chelating agent solution containing radioactive contaminants, which can significantly decrease the amount of the chelating agent solution containing the radioactive contaminants.

Another object of the present invention is to provide a method of treating a chelating agent solution containing radioactive contaminants, which can decrease the load on the ion exchange resin and thus significantly decrease the amount of the ion exchange resin containing the radioactive contaminants.

In order to achieve the objects, the present invention provides a method of treating a chelating agent solution containing radioactive contaminants, comprising electrolyzing a chelating agent solution containing metal ions as radioactive contaminants by a direct current to form an aqueous solution having no chelating property, reacting the metal ions in the aqueous solution with a holding agent for holding the metals ions to form a water-insoluble substance, and separating the holding agent which holds the metals ions from the aqueous solution.

In accordance with the present invention, a method of treating a chelating agent solution containing radioactive contaminants is further provided in which the holding agent is one selected from a coagulant-precipitant and a metal scavenger.

In accordance with the present invention, a method of treating a chelating agent solution containing radioactive contaminants is further provided in which separation is performed by using a filter.

In accordance with the present invention, a method of treating a chelating agent solution containing radioactive contaminants is further provided in which a filtrate obtained by filtration for removing the holding agent is treated with an ion-exchange resin to produce purified water.

In accordance with the present invention, a method of treating a chelating agent solution containing radioactive contaminants is further provided in which a chelating agent is added to the purified water to form a chelating agent solution which is used for decontaminating a radioactive contaminated substance.

In the present invention having the above construction, the chelating agent solution containing metal ions as radioactive contaminants is electrolyzed to form an aqueous solution having no chelating property, and the holding agent such as a coagulant-precipitant or a metal scavenger which holds the metal ions to form a water-insoluble substance is treated with the aqueous solution to hold the metal ions by the holding agent, and is then separated from the aqueous solution. Thus, the present invention can significantly decrease the amount of the chelating agent solution containing radioactive contaminants, as compared with a conventional method.

Since the aqueous solution from which the holding agent for holding the metal ions is removed is supplied to the ion-exchange resin, the load on the ion-exchange resin is significantly decreased, and the amount of the ion-exchange resin contaminated with radioactivity is thus significantly decreased, as compared with a conventional method.

A method using the gases generated by electrolysis is described below. A chelating agent solution having radioactive contaminants is electrolyzed to eliminate the chelating property, and the gases generated from an anode are collected and repeatedly passed throughout the chelating agent solution to oxidize the metal ions contained in the solution and, at the same time, precipitate, as a compound, sodium in the chelating agent solution.

The oxidized metal ions, the sodium compound and so on are precipitated by adding the coagulant-precipitant, and then filtered. Since the thus-obtained filtrate is passed through the ion-exchange resin, the load on the ion-exchange resin is significantly decreased. In addition, the solution passed through the ion-exchange resin can be used as purified water, and a chelating agent is added to the purified water to form a chelating agent solution which can be used again for decontaminating a radioactive contaminated substance.

In this way, the amount of the chelating agent solution having radioactive contaminants, which is discharged to the outside and stored, can significantly be decreased.

As described above, the load on the ion-exchange resin can significantly be decreased. Thus, the amount of the ion-exchange resin on which radioactive contaminants adsorb can significantly be decreased.

In a method using air, oxygen or ozone, one selected from air, oxygen and ozone is passed through a chelating agent solution containing radioactive contaminants to oxidize metal ions in the chelating agent solution, and a coagulant-precipitant is added to the solution to precipitate the metal ions, followed by filtration for removing the precipitates. The thus-obtained filtrate is further electrolyzed to obtain precipitates which are then removed by filtration, and the filtrate is supplied to the ion-exchange resin. Thus, the amount of the radioactive contaminants supplied to the ion-exchange resin is significantly decreased, and only small amounts of radioactive contaminants are supplied to the ion-exchange resin. As a result, the load on the ion-exchange resin can significantly be decreased.

Therefore, the amount of the ion-exchange resin having radioactive contaminants can significantly be decreased, and the chelating agent solution containing radioactive contaminants can be separated as purified water, as described above. In addition, since a chelating agent is added to the purified water to form a chelating agent solution used again for decontamination, the amount of the chelating agent solution having radioactive contaminants, which must be discharge to the outside and stored, can significantly be decreased.

The operation of a method using the metal scavenger is described below. The metal scavenger is added to the chelating agent solution having radioactive contaminants to precipitate the dissolved metals as flocks, and the precipitates are then filtered. The thus-obtained filtrate is farther electrolyzed, and the produced precipitates are filtered. The filtrate is supplied to the ion-exchange resin to adsorb small amounts of remaining radioactive contaminants thereon. Thus, the load on the ion-exchange resin can significantly be decreased.

Consequently, the amount of the ion-exchange resin having radioactive contaminants can also significantly be decreased. Since purified water can be obtained by the above method, a chelating agent is added to the purified water to form a chelating agent solution used for decontaminating a radioactive contaminated substance again. Therefore, the amount of the chelating agent solution containing radioactive contaminants, which must be stored, can significantly be decreased, as described above.

DETAILED DESCRIPTION OF THE INVENTION

Figure 1:
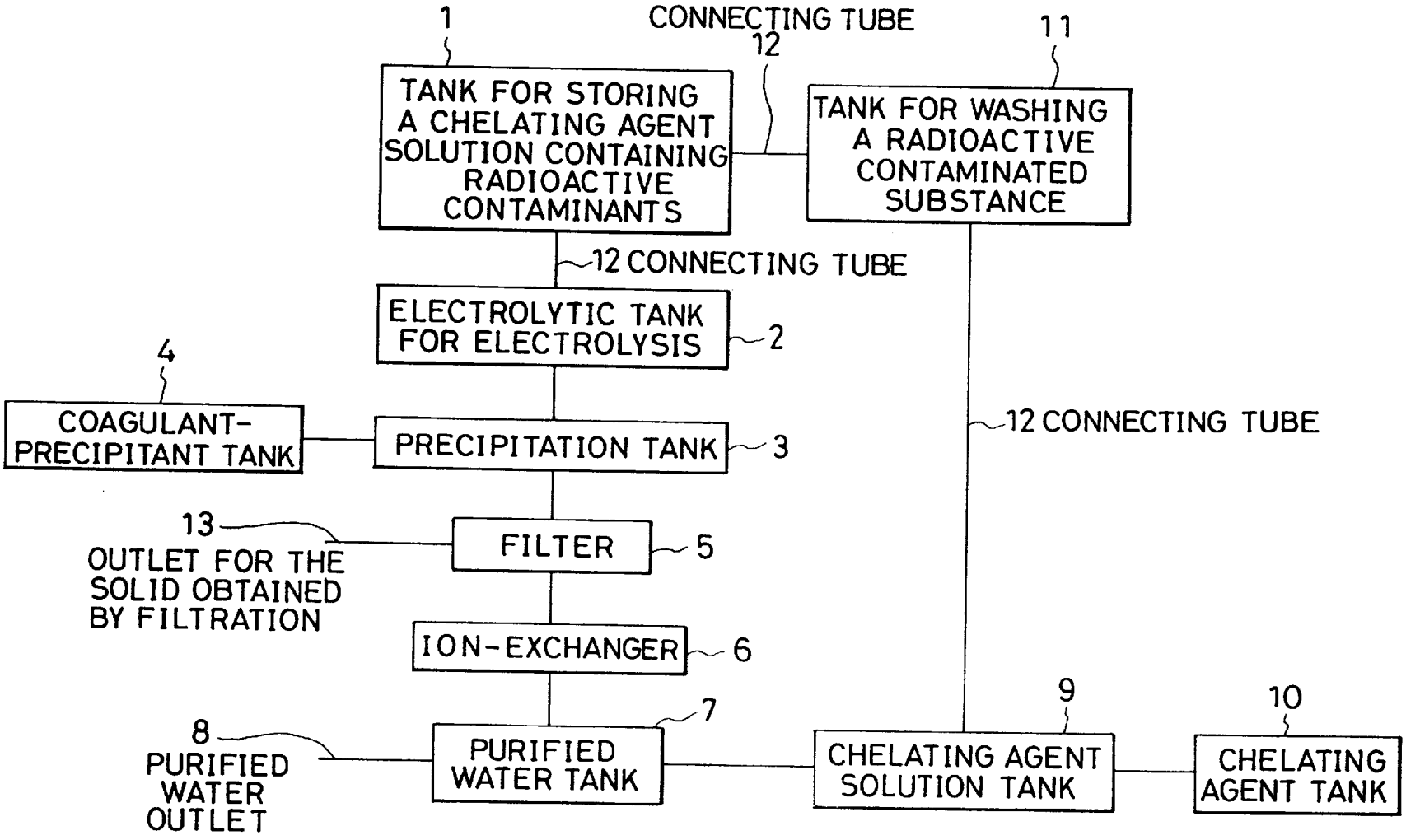
FIG. 1 is a block diagram illustrating a method of treating a chelating agent solution having radioactive contaminants in accordance with an example of the present invention.

In FIG. 1, reference numeral 1 denotes a tank for storing a chelating agent solution containing radioactive contaminants. Reference numeral 2 denotes an electrolytic tank for electrolysis. Although not shown in the drawing, the tank 2 is designed so that the gas generated from an anode can be collected and repeatedly passed therethrough. Reference numeral 3 denotes a precipitation tank to which a coagulant-precipitant is supplied from a coagulant-precipitant tank 4. Sodium hydroxide, ammonia water, potassium ferrocyanide or the like is used as the coagulant-precipitant. Reference numeral5 denotes a filter; reference numeral 6, an ion-exchanger, reference numeral 7, a purified water tank; reference numeral 8, a purified water outlet; reference numeral 9, a chelating agent solution tank; and reference numeral 10, a chelating agent tank.

Reference numeral 11 denotes a tank for washing a radioactive contaminated substance, for example, the tank having an ultrasonic vibrator (not shown). In the washing tank 11, the radioactive contaminated substance (not shown) is washed and decontaminated with the chelating agent solution by using the ultrasonic vibrator (not shown).

The chelating agent solution containing the radioactive contaminants is stored in the chelating agent solution tank 1, and supplied to the electrolytic tank 2. In the electrolytic tank 2, the chelating agent solution is electrolyzed for eliminating the chelating property of the chelating agent solution to form a non-chelating aqueous solution. The gases such as oxygen, nitrogen, carbon dioxide gas, and so on, which are generated from an anode in electrolysis, are repeatedly supplied to the electrolytic tank 2.

As a result, the metal ions in the aqueous solution are oxidized, and, at the same time, precipitates are produced in the aqueous solution due to the generation of a carbonic acid compound of Na.

The aqueous solution is then transferred to the precipitation tank 3 to which the coagulant-precipitant (for example, potassium ferrocyanide) is supplied from the coagulant-precipitant tank 4 for precipitating the oxidized metal ions. The thus-produced precipitates are filtered off by the filter 5, and removed from an outlet 13.

The aqueous solution from which the precipitates are removed by the above method is then supplied to the ion-exchange resin 6 to form purified water by ion-exchange. The purified water is discharged from the outlet 8 or transferred to the chelating agent tank 9 without being discharged. A chelating agent is supplied to the tank 9 from the chelating agent tank 10 connected thereto to form a chelating agent solution, which is supplied to the washing tank 11 through a connecting tube 12. In the washing tank 11, a radioactive contaminated substance (not shown) is washed with the cheating agent solution. The obtained chelating agent solution having radioactive metal ions is transferred to the chelating agent solution tank 1, and is then supplied to the electrolytic tank 2 from the tank 1. The above process is repeated.

Figure 2:
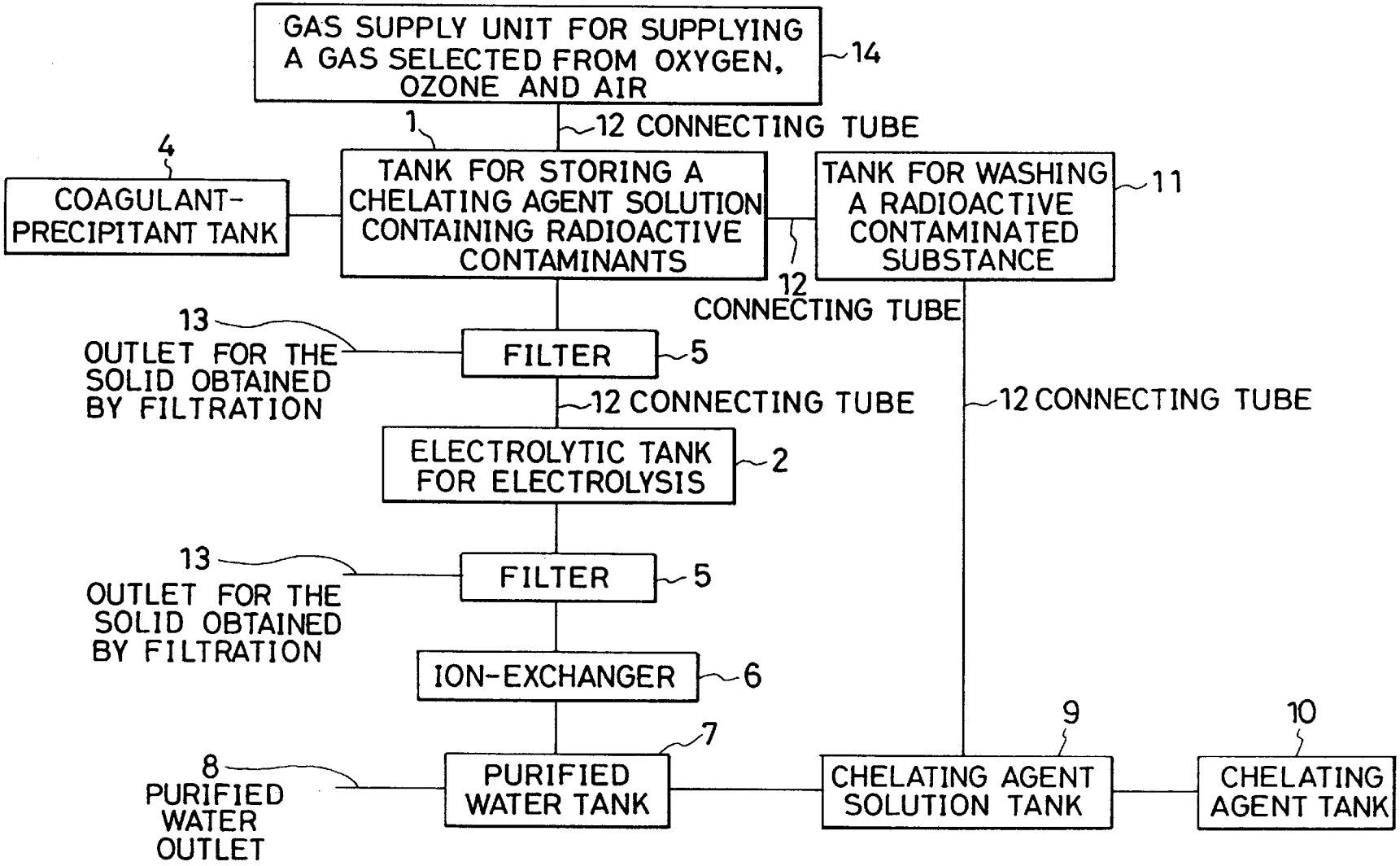
FIG. 2 is a drawing illustrating a second example of the present invention corresponding to FIG. 1.

FIG. 2 shows a second example of the present invention. In FIG. 2, reference numeral 1 denotes a tank for a chelating agent solution having radioactive contaminants stored therein. Reference numeral 14 denotes a gas supply unit for supplying a gas selected from oxygen, ozone and air. Reference numeral 4 denotes a coagulant-precipitant tank which can supply the sedimenting agent to the chelating agent solution tank 1. Reference numeral 5 denotes a filter, and reference numeral 13 denotes an outlet for the solid obtained by filtration.

Reference numeral 2 denotes an electrolytic tank for electrolysis; reference numeral 6, an ion-exchanger; reference numeral 7, a purified water tank; reference numeral 8, a purified water outlet; reference numeral 9, a chelating agent solution tank; reference numeral 10, a chelating agent tank; reference numeral 11, a tank for washing a radioactive contaminated substance; and reference numeral 12, a connecting tube.

The chelating agent solution having radioactive contaminants is stored in the tank 1, and a gas selected from oxygen, ozone and air is supplied to the chelating agent in the tank 1 from the gas supply unit 14 to oxidize the metal ions in the chelating agent solution in the tank 1.

The coagulant-precipitant, e.g., potassium ferrocyanide, is supplied to the chelating agent solution from the coagulant-precipitant tank 4 to precipitate the metal ions, and the entire solution is filtered by the filter 5. The solid obtained by filtration is separated from the outlet 13. The obtained filtrate is then electrolyzed in the electrolytic tank 2 to eliminate the cheating property. Consequently, the metal ions contained in the chelating agent solution are precipitated. The entire solution is further filtered by the filter 5 to remove the precipitates from the outlet 13. The filtrate is then supplied to the ion-exchanger 6 and treated therein to, obtain purified water. The purified water is collected from the outlet 8 of the purified water tank 7.

Alternatively, the purified water is transferred to the chelating agent solution tank 9 without being discharged, and the chelating agent is supplied to the purified water from the chelating agent tank 10 to form a chelating agent solution. The thus-formed chelating agent solution is then supplied to the washing tank 11. In the washing tank 11, a substance contaminated with radioactivity is washed and decontaminated with the chelating agent solution.

The chelating agent solution containing radioactive contaminants formed by decontamination is then transferred to the chelating agent solution tank 1, and the above-described process is repeated.

Figure 3:
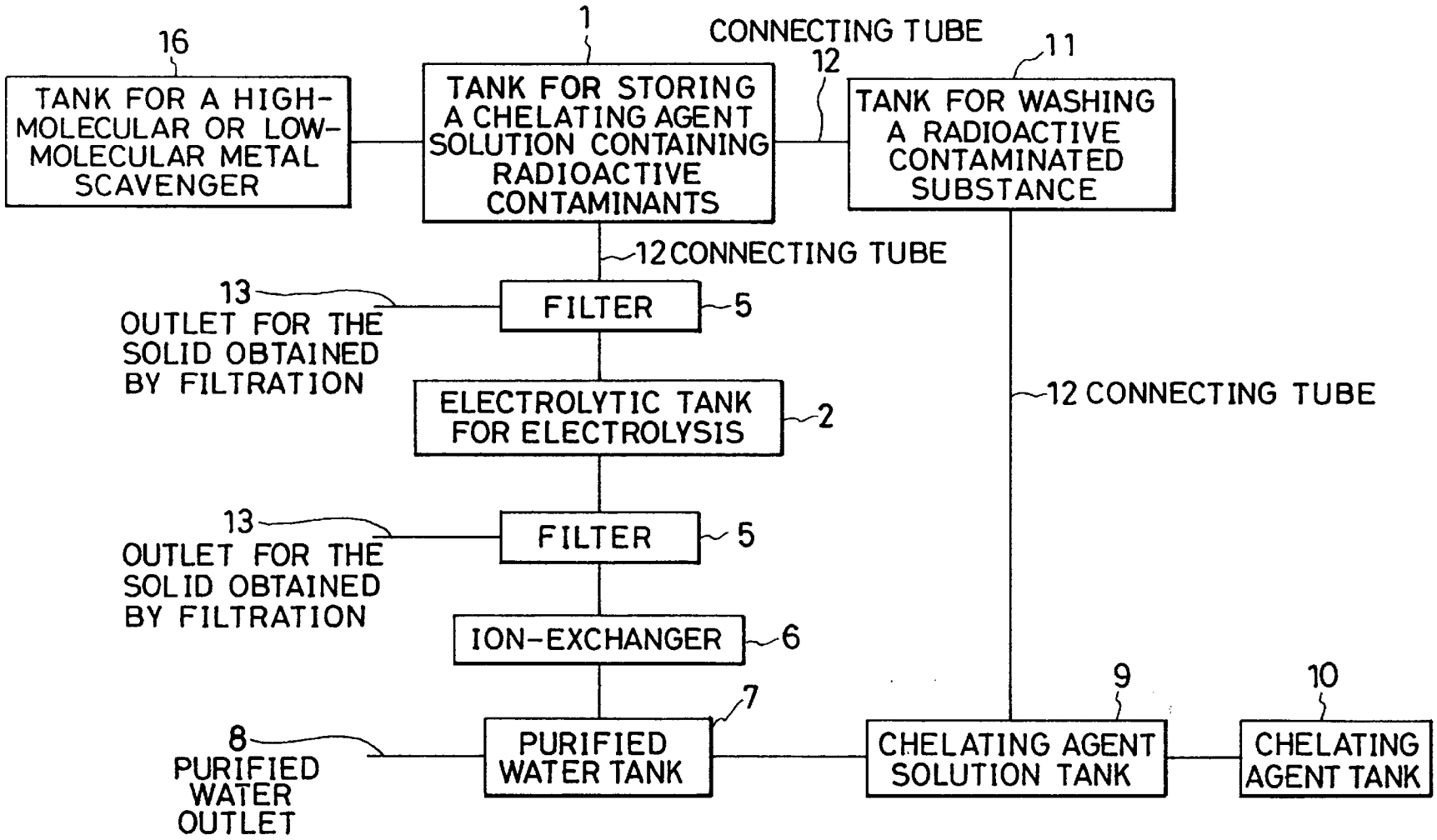
FIG. 3 is a drawing illustrating a third example of the present invention corresponding to FIG. 1.

In FIG. 3, the same reference numerals as those shown in FIGS. 1 and 2 denote the same units, and are not described below for the sake of simplification.

In FIG. 3, reference numeral 16 denotes a tank for a high-molecular or low-molecular metal scavenger. A commercial high-molecular metal scavenger or low-molecular metal scavenger is used as the scavenger. The chelating agent solution containing radioactive contaminants is stored in the tank 1, and a high-molecular metal scavenger as an example is supplied to the tank 1 from the scavenger tank 16 to precipitate as flocks the radioactive contaminants contained in the chelating agent solution. The precipitates are then filtered off by the filter 5 and then discharged from the outlet 13. The thus-obtained filtrate is then electrolyzed in the electrolytic tank 2 to decompose the chelating agent in the chelating agent solution. The precipitates produced by the electrolysis are again filtered off by the filter 5. The filtrate from which the precipitates are removed is treated in the ion-exchanger 6 to obtain purified water in the tank 7.

The purified water may be discharged from the outlet 8 or transferred to the chelating agent solution tank 9 to which the chelating agent is supplied from the chelating agent tank 10 and agitated to form a chelating agent solution. The thus-formed chelating agent solution is transferred to the washing tank 11 and used for washing a radioactive contaminated substance (not shown).

When a chelating agent solution containing radioactive contaminants is produced, the chelating agent solution is sent to the tank 1, and the above process is repeated.

In the present invention having the above construction, the chelating property of the chelating agent solution containing radioactive contaminants is eliminated by electrolysis, and metal ions are made water-insoluble by employing the elimination of the chelating property and a holding agent such as a coagulant-precipitant or a high-molecular or low-molecular metal scavenger, and then separated by separation means such as a filter or the like. It is thus possible to significantly decrease the load on the ion-exchange resin.

Consequently, the amount of the ion-exchange resin to which radioactive contaminants are adsorbed can significantly be decreased, as compared with a conventional method. Further, the amount of the chelating agent solution containing radioactive contaminants, which must be stored, can significantly be decreased, as compared with a conventional method.

The following example is intended to illustrate the invention without limiting its scope.

EXAMPLE

Figure 4:
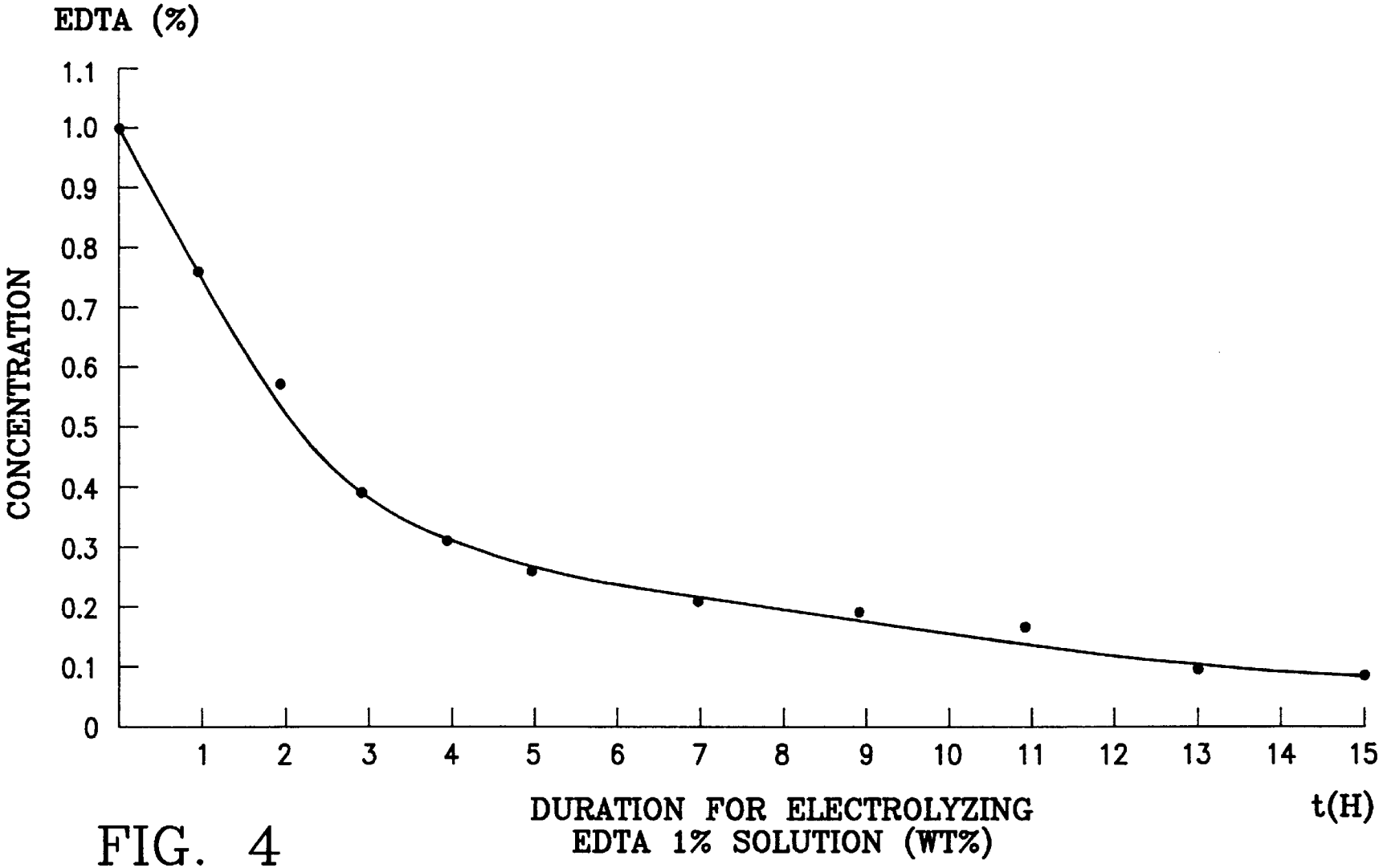
FIG. 4 is a graphic representation of concentration versus duration of electrolyzing.

The following example is described in reference to FIGS. 1 and 4. In FIG. 1, reference numeral 11 denotes the tank for washing the radioactive substance. Washing tank 11 can include an ultrasonic vibrator to enhance washing of the radioactive contaminated solution with chelating agent from chelating agent solution tank 1.

A 1% ethylenediaminetetraacetic acid solution EDTA) was used as the chelating agent solution. The chelating agent solution which had been used for the above-mentioned washing was stored in the chelating agent solution tank 1. Five liters of the chelating agent solution was supplied to an electrolyzing tank 2. The electrolyzing tank 2 included two plate electrodes (not shown), each of which was a platinized plate of titanium. A direct current was utilized to electrolytically treat the solution. The electric current density was 0.8 $A/dm^2$, the area of each electrode was 6 $dm^2$ and the temperature of the chelating agent solution was maintained at 40° C. under one atmospheric pressure.

Results of the electrolytic treatment of the solution are shown in the graph of FIG. 4. In FIG. 4, the horizontal axis of the graph represents duration of the electrolytic treating (hours) and the vertical axis of the graph represents concentration of EDTA.

As shown in FIG. 4, initial concentration of EDTA was 1.0% before electrolytic treatment. The EDTA concentration was 0.4% after three hours of treatment, 0.2% after nine hours and 0.1% after 13 hours.

The electrolytic treatment resulted in release of metal ions from chelating agent and deposit of the metal ions on the cathode as metals. At the same time, the chelating agent was oxidized at the anode. With oxidation of the chelating agent at the anode, the solution lost its chelating property and its ability to bind metal ion.

Oxygen, nitrogen, carbon dioxide gas, and other gases are generated by oxidization of the chelating agent at the anode. These gases are repeatedly supplied to the electrolyzing tank 2. In order to extinguish the chelating property of the solution by electrolytic treatment, the chelating agent must be permitted to directly access the anode. Interfering structures, such as an intervening ion-exchange membrane, that prevent the chelating agent from oxidation at the anode do not result in a solution without chelating properties and will not permit metal ions to be separated with a holding agent and separated by filtration or the like in subsequent steps.

Further modifications of the present invention will occur to those skilled in the art subsequent to a review of the present application. These modifications and equivalents thereof are intended to be included within the scope of the invention.

What is claimed:

1. A method of treating a chelating agent solution containing radioactive contaminants, comprising:

electrolyzing a chelating agent solution containing metal ions as radioactive contaminants by a direct current to form an aqueous solution having no chelating property;

treating said metal ions in said aqueous solution with a holding agent which holds the metal ions to form a water-insoluble substance to hold said metal ions; and separating said holding agent which holds said metal ions from said aqueous solution.

2. A method of treating a chelating agent solution containing radioactive contaminants according to claim 1, wherein said holding agent is one selected from a coagulant-precipitant and metal scavenger.

3. A method of treating a chelating agent solution containing radioactive contaminants according to claim 1, wherein separation is performed by a filter.

4. A method of treating a chelating agent solution containing radioactive contaminants according to claim 3, wherein a filtrate obtained by filtration for removing said holding agent is treated with an ion-exchange resin to produce purified water.

5. A method of treating a chelating agent solution containing radioactive contaminants according to claim 4, wherein a chelating agent is added to said purified water to form a chelating agent solution used for decontaminating a radioactive contaminated substance.

6. A method of treating a chelating agent solution containing radioactive contaminants according to claim 2, wherein separation is performed by a filter.

7. A method of treating a solution containing radioactive contaminants, comprising:

providing a chelating agent solution containing radioactive contaminated metal ions;

electrolytically treating said solution to oxidize said chelating agent; and treating said metal ions with a holding agent to form a water insoluble metal containing product.

8. The method of, claim 7 wherein said holding agent is a coagulant-precipitant or metal scavenger.

9. The method of, claim 7 comprising separating said water insoluble metal containing product from said solution.

10. The method of claim 9, comprising separating said water insoluble metal containing product by means of a filter to produce a filtrate.

11. The method of claim 10, comprising treating said filtrate with an ion-exchange resin to produce purified water.

12. The method of claim 11, comprising adding a chelating agent to said purified water to form chelating agent solution for decontaminating a solution containing radioactive contaminants.

13. A method of treating a solution containing radioactive contaminants, comprising:

providing a first chelating agent solution containing radioactive contaminated metal ions;

electrolytically treating said first solution to oxidize said chelating agent;

treating said metal ions with a holding agent to form a water insoluble metal containing product;

separating said water insoluble metal containing product from said first solution;

treating said first solution with an ion-exchange resin to produce a purified water;

adding chelating agent to said purified water to form a chelating agent solution;

mixing said chelating solution with a second solution containing radioactive contaminated metal ions; and treating said second solution according to the method of claim 7.

14. The method of claim 13, wherein said holding agent is a coagulant-precipitant or metal scavenger.

15. A method of treating a solution containing radioactive contaminants comprising:

providing a chelating agent solution containing radioactive contaminated metal ions;

supplying a gas selected from oxygen, ozone and air to said solution;

treating said solution with a holding agent to form a water insoluble metal containing product;

separating said water insoluble metal containing product to provide a chelating agent solution containing at least some radioactive contaminated metal ions; and electrolytically treating said chelating agent solution containing at least some radioactive contaminated metal ions according to the method of claim 7.

16. A method of treating a solution containing radioactive contaminants comprising:

providing a solution containing radioactive contaminated metal ions and cheating agent;

supplying a gas selected from oxygen, ozone and air to said solution;

treating said solution with a holding agent to form a water insoluble metal containing product;

separating said water insoluble metal containing product to provide a solution containing at least some radioactive contaminated metal ions and chelating agent; and electrolytically treating said solution containing at least some radioactive contaminated metal ions and cheating agent according to the method of claim 13.

17. A method of treating a solution containing radioactive contaminated metal ions, comprising:

supplying a coagulant-precipitant to a chelating agent solution containing radioactive contaminated metal ions to precipitate metal ions;

filtering said solution to obtain a filtrate containing radioactive contaminated metal ions; and electrolytically treating said filtrate according to the method of claim 7.

18. A method of treating a solution containing radioactive contaminated metal ions, comprising:

supplying a coagulant-precipitant to a chelating agent solution containing radioactive contaminated metal ions to precipitate metal ions;

filtering said solution to obtain a filtrate containing radioactive contaminated metal ions; and treating said filtrate according to the method of claim 13.

19. A method of treating a solution containing radioactive contaminated metal ions, comprising:

supplying a coagulant-precipitant to a chelating agent solution containing radioactive contaminated metal ions to precipitate metal ions;

filtering said solution to obtain a first filtrate containing radioactive contaminated metal ions; and treating said first filtrate with a holding agent;

filtering said first filtrate to remove metal and to provide a second filtrate; and electrolytically treating said second filtrate according to the method of claim 7.

20. A method of treating a solution containing radioactive contaminated metal ions, comprising:

supplying a coagulant-precipitant to a chelating agent solution containing radioactive contaminated metal ions to precipitate metal ions;

filtering said solution to obtain a first filtrate containing radioactive contaminated metal ions;

treating said first filtrate with a holding agent;

filtering said first filtrate to remove metal and to provide a second filtrate; and electrolytically treating said second filtrate according to the method of claim 13.

* * * * *